US005248147A

United States Patent [19]

Smith

[11] Patent Number: 5,248,147

[45] Date of Patent: Sep. 28, 1993

[54] SPORTING GAME

[76] Inventor: David N. S. Smith, 7 Meyer Road, Bordeaux, Randburg, South Africa

[21] Appl. No.: 882,236

[22] Filed: May 8, 1992

Related U.S. Application Data

[63] Continuation of Ser. No. 739,444, Aug. 2, 1991, abandoned.

[30] Foreign Application Priority Data

Aug. 1, 1990 [ZA] South Africa ..... 90/6053

[51] Int. Cl.[5] ..... A63F 3/00

[52] U.S. Cl. ..... 273/244; 273/431

[58] Field of Search ..... 273/243-254

[56] References Cited

U.S. PATENT DOCUMENTS

| | | | |
|---|---|---|---|
| 2,717,156 | 9/1955 | Nelson | 273/248 |
| 4,121,823 | 10/1978 | McBride | 273/249 |
| 4,323,249 | 4/1982 | Brady | 273/249 |
| 4,856,780 | 8/1989 | Begley et al. | 273/249 |

*Primary Examiner*—Benjamin H. Layno

*Attorney, Agent, or Firm*—Burns, Doane, Swecker & Mathis

[57] ABSTRACT

The invention provides a sporting game which includes a board defining a pathway on which players can move tokens by throwing dice. Different blocks on the pathway are marked to indicate different categories of questions, and different sets of cards are provided for the different categories of questions. The cards have illustrations on them to which questions on the cards relate. At least some of the sets of cards have questions and illustrations relating to rules and techniques of the sport.

3 Claims, 2 Drawing Sheets

| NAME | GAME | PREVIOUS SET | | | | |
|---|---|---|---|---|---|---|
| | | 1 | 2 | 3 | 4 | 5 |
| D BROWN | 4 | 6 | 3 | | | |
| NAME | GAME | 1 | 2 | 3 | 4 | 5 |
| C GREEN | 5 | 4 | 6 | | | |

| NAME | GAME | PREVIOUS SET | | | | |
|---|---|---|---|---|---|---|
| | | 1 | 2 | 3 | 4 | 5 |
| D BROWN | 4 | 6 | 3 | | | |
| NAME | GAME | 1 | 2 | 3 | 4 | 5 |
| C GREEN | 5 | 4 | 6 | | | |

FIG 2
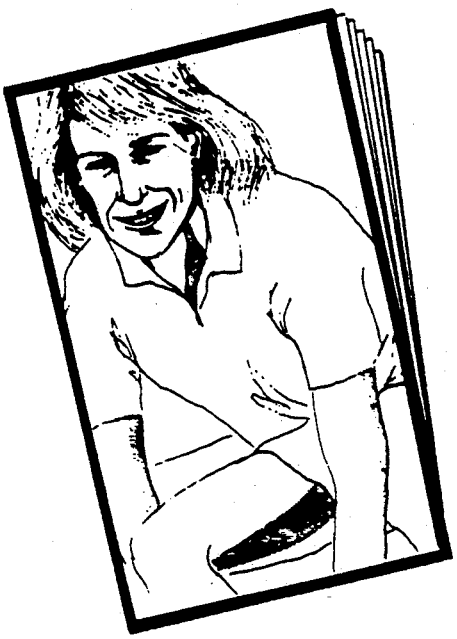
FIG 3
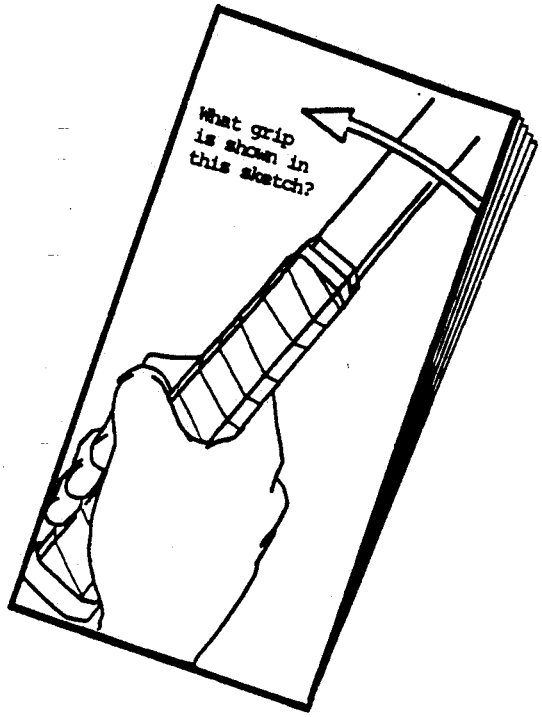
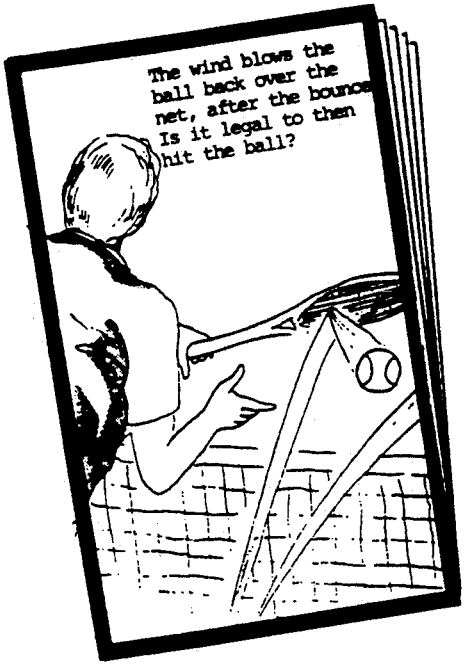
FIG 4
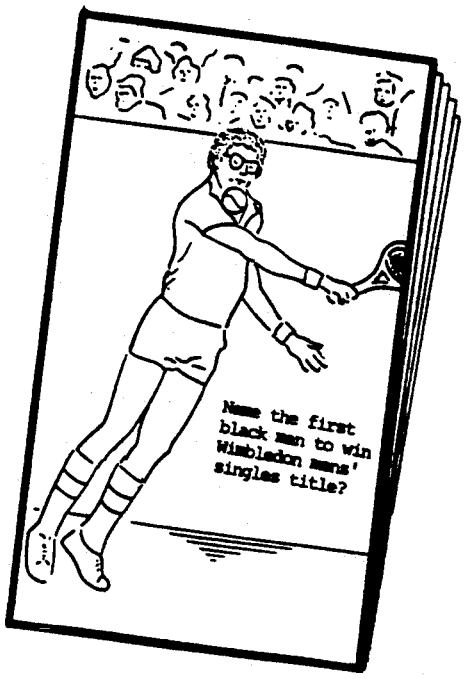
FIG 5

SPORTING GAME

This application is a continuation of application Ser. No. 07/739,444, filed Aug. 2, 1991 now abandoned.

BACKGROUND OF THE INVENTION

This invention relates to apparatus for playing a game, which is based on a selected sport.

SUMMARY OF THE INVENTION

According to the invention game apparatus comprises:

a playing board;

a pathway defined on the board and comprising a plurality of blocks;

markings in at least some of the blocks identifying respective different categories of questions to be answered by players of the game;

at least two sets of cards, the cards of each set corresponding to a respective category of questions; and illustrations on the cards of at least one of the sets of cards, each illustration relating to the question on the respective card and illustrating a rule, strategy or technique of the sport.

The apparatus will normally include one or more dice and a number of tokens which players can move along the pathway according to throws of the dice.

The categories of questions may include questions about well-known players of the sport, or the history of the sport.

Apart from the blocks referred to above, the pathway may include blocks marked to indicate bonuses or penalties, which are preferably defined in terms of the rules of the sport in question.

BRIEF DESCRIPTION OF THE DRAWINGS

FIGS. 2 to 5 illustrate typical cards of the apparatus; and

DESCRIPTION OF AN EMBODIMENT

Figures 1, 6:
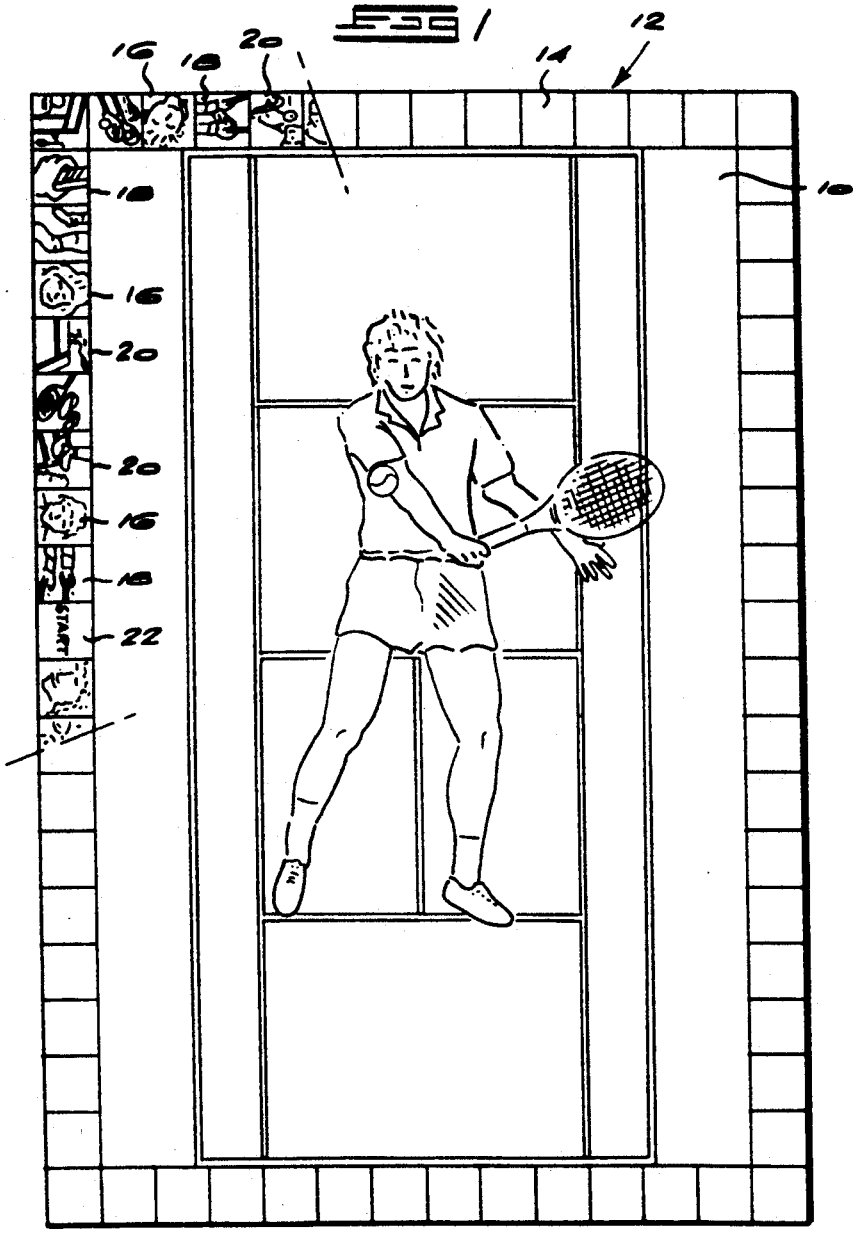
FIG. 1 is a top view of a playing board of game apparatus according to the invention.
FIG. 6 illustrates a scoresheet of the apparatus.

The illustrated game apparatus is a board game which is based on the sport of tennis. FIG. 1 illustrates a rectangular board 10 which has a pathway 12 about its periphery which is divided into blocks 14. Different blocks bear different markings and may be coloured differently, as illustrated by way of example in the upper left hand portion of the drawing. The centre portion of the board 10 is marked to define a tennis court with a tennis player superimposed thereon.

The apparatus includes three sets of cards, illustrated in FIGS. 2, 3 and 4. The sets of cards correspond to respective different categories of questions which are asked during the playing of the game. One set of cards (illustrated in FIG. 2) corresponds to a category of questions about well known tennis players. For example, the cards may bear a likeness of a tennis player, as illustrated, who must be identified by a player of the game. The second category of cards, illustrated in FIGS. 3 and 4, corresponds to a category of questions on rules, strategies and techniques of the sport. The cards illustrated in FIG. 3 correspond to questions on techniques, such as hand grips, standard playing strokes or other techniques, while the cards illustrated in FIG. 4 correspond to questions relating to rules of the sport.

Separate sets of cards can, of course, be provided relating to rules, strategies and techniques respectively. The third category of cards corresponds to a category of questions on the history of the sport, which may include illustrations or only printed questions (see FIG. 5). This category may include questions relating to sporting venues, names of teams, the origin of the sport, and details of competitions, for example.

In each of the above cases, the illustrations on the cards either form the basis of the question to be asked, in the sense that the question is derived from the illustration itself, or supplement a printed question, as is the case with the cards illustrated in FIGS. 3 and 4.

On the pathway 12 are blocks 14 which are coloured differently and which are marked to indicate the different categories of questions to be asked. For example, blocks 16 in the prototype game are coloured pink and are marked with representations of players. Blocks 18 are coloured yellow and are marked to indicate that a player landing on those blocks must answer a question relating to a rule, strategy or technique of the sport, while blocks 20 are coloured green and are marked to indicate that a player landing on those blocks must answer a question relating to the history of the sport.

Further categories of blocks exist, some of which define penalties or bonuses for players. The penalties or bonuses are preferably defined in terms of the rules of the sport in question. For example, in the case of the described tennis game, penalties may be defined as double faults, lets, or foot faults. According to the rules of the game, the flow and rules of the sport in question are imitated as far as possible, and players keep score in the same way as actual players of the sport would. Thus, the penalties and bonuses are applied to affect the score in the same way as if a real game were being played. Score sheets are provided, marked accordingly, as shown in FIG. 6.

The illustrated score sheet is essentially the same in layout as the score boards seen at tennis tournaments. The score sheet in FIG. 6 is printed on card or paper, and is shown partially filled in. The scoresheets allow the scores of previous "sets" and "games" to be recorded. The intention of providing scoresheets of this type is that players of the game should be able to score correctly when playing the actual sport, subsequent to having played the game. In addition, after playing the game, players should have absorbed rules, strategies and techniques such as where to stand on the court, how to hold the racket, how to behave on the court, and so on.

To play the game, players take turns to throw the dice and move their tokens from a START block 22 around the pathway. When players answer a question correctly they score points as if they had won a point in a game of tennis. When players land on bonus or penalty blocks, their score is automatically increased or reduced according to the nature of the bonus or penalty.

The described game is intended to assist in the coaching of players of the sport to which the game relates. The concentration of the game on the rules, strategies and techniques of the sport in question reflects this, as does the scoring system of the game, which reflects the scoring system of the sport to which the game apparatus relates. The intention is thus that players of the game are effectively exposed to a competitive situation which relates as closely as possible to the sport in question, notwithstanding the fact that the apparatus is relatively simple and inexpensive.

It will be appreciated that the apparatus can be adapted to different sports. It is merely necessary to adapt the markings of the blocks 14 and the illustrations and questions on the cards to the sport in question.

I claim:

1. A method of playing a board game relating to the sport of tennis in a manner simulating the scoring system of the sport, comprising the steps of:

a first player operating a change device to establish a number of moves and moving a first token along a pathway on a board, the pathway comprised of successive blocks, a first plurality of the blocks containing markings identifying a first category of questions to be asked regarding a first aspect of tennis, and a second plurality of blocks containing markings identifying a second category of questions to be asked regarding a second aspect of tennis, said first player attempting to answer a question taken from one of said sets of cards corresponding to a block on which said first token lands and receiving a point if the question is answered correctly, said second player operating said chance device to establish a number of moves and moving a second token along said pathway by a number of blocks corresponding to said number of moves, said second player attempting to answer a question taken from one of said sets of cards corresponding to a block on which said token lands and receiving a point if the question is answered correctly, a player who attains a total of at least four points while simultaneously outscoring the other player by at least two points being awarded a game, a player who attains a total of at least six games while simultaneously outscoring the other player by at least two games being awarded a set.

2. A method according to claim 1, wherein the games won by each player are recorded on a game-score portion of a scorecard configured to simulate a tennis scoreboard, and the sets won by each player are recorded on a sets-won portion of said scoreboard.

3. A tennis game apparatus, comprising:

a playing board forming a pathway, comprised of a plurality of successive blocks containing markings identifying a first category of questions to be asked regarding a first aspect of tennis, and a second plurality of blocks containing markings identifying a second category of questions to be asked regarding a second aspect of tennis, first and second sets of cards containing questions corresponding to said first and second categories of questions, respectively, a chance device for determining a number of moves, tokens for representing respective players, and a scorecard simulating a tennis scoreboard, said scorecard containing a first portion for identifying the players, a second portion for recording games won by the players, and a third portion divided into sections representative of respective tennis sets, each said section including an area for recording games won by each player during a respective set.

* * * * *